US005095572A

United States Patent [19]

Wagner

[11] Patent Number: 5,095,572

[45] Date of Patent: Mar. 17, 1992

[54] AUTOMATED CLEANING DEVICE FOR BEVERAGE DRAFTING AND DISPENSING SYSTEMS

[76] Inventor: Ewald G. Wagner, Bachstr. 37a, 5403 Mülheim-Kärlich 1, Fed. Rep. of Germany

[21] Appl. No.: 523,428

[22] Filed: May 15, 1990

[30] Foreign Application Priority Data

May 24, 1989 [DE] Fed. Rep. of Germany ..... 3916952

[51] Int. Cl.[5] ..... B08B 9/04

[52] U.S. Cl. ..... 15/3.51; 15/104.062; 137/242

[58] Field of Search ..... 15/3.5, 3.51, 104.062; 137/237-240, 242, 268

[56] References Cited

U.S. PATENT DOCUMENTS 2,095,823 10/1937 Marshall ..... 15/3.51
2,331,460 10/1943 Davis ..... 15/3.51
2,827,070 3/1958 Gatz ..... 15/3.51 X

*Primary Examiner*—Edward L. Roberts
*Attorney, Agent, or Firm*—Evenson, Wands, Edwards, Lenahan & McKeown

[57] ABSTRACT

An automated cleaning device for beverage drafting/-dispensing systems uses cleaning balls to clean tap lines. The cleaning balls are pushed through the lines by clean, pressurized water. The cleaning device includes a dual-acting hydraulic cylinder which is operated by means of an electric control system and solenoid valves. This dual-acting hydraulic cylinder is an integrated feature of a sliding valve system which retrieves the cleaning balls from a retention hopper through a cylindrical slide, inserting the cleaning balls alternately into either a tap line leading to a tapping cock or into a tap line leading to a keg, assisted by pressurized water. In the drafting/dispensing position, the sliding valve provides an uninterrupted connection between the two lines. The sliding valve can be operated from a remote switching location or manually.

16 Claims, 8 Drawing Sheets

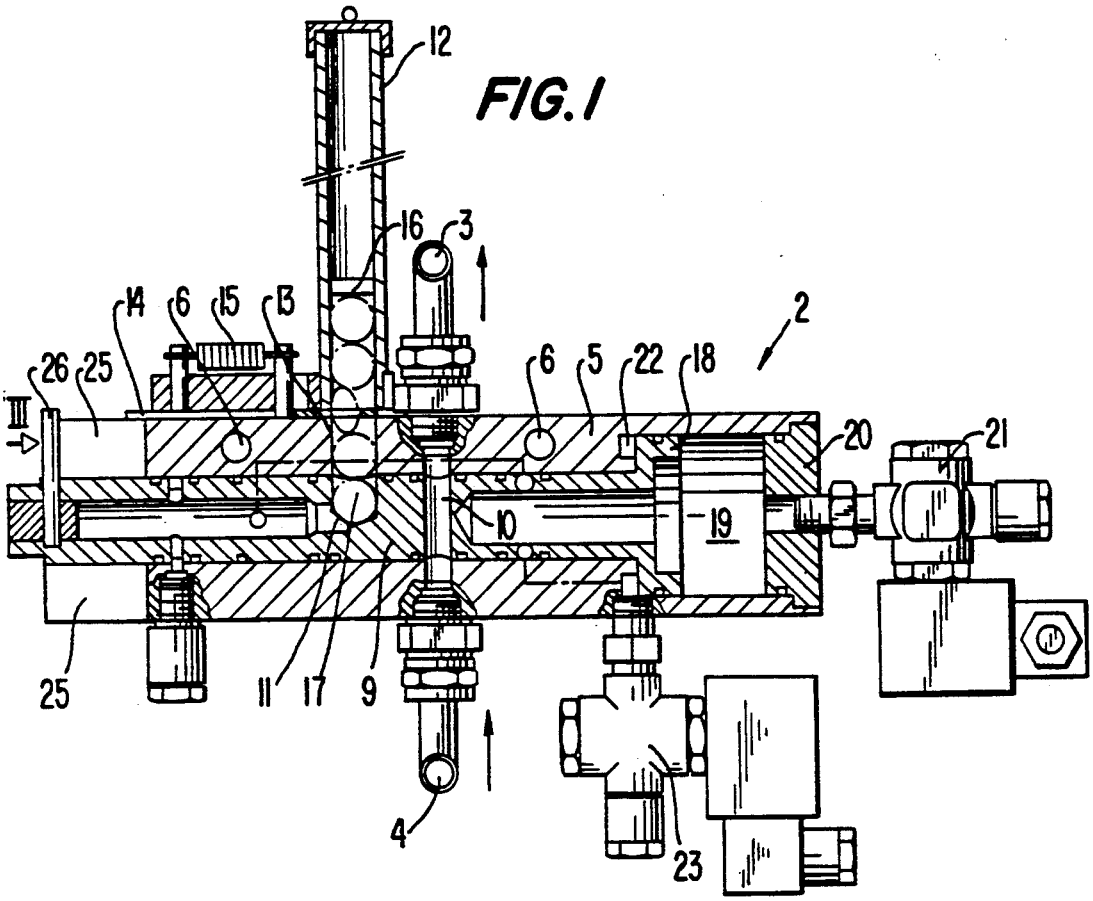
FIG. 1
FIG. 2
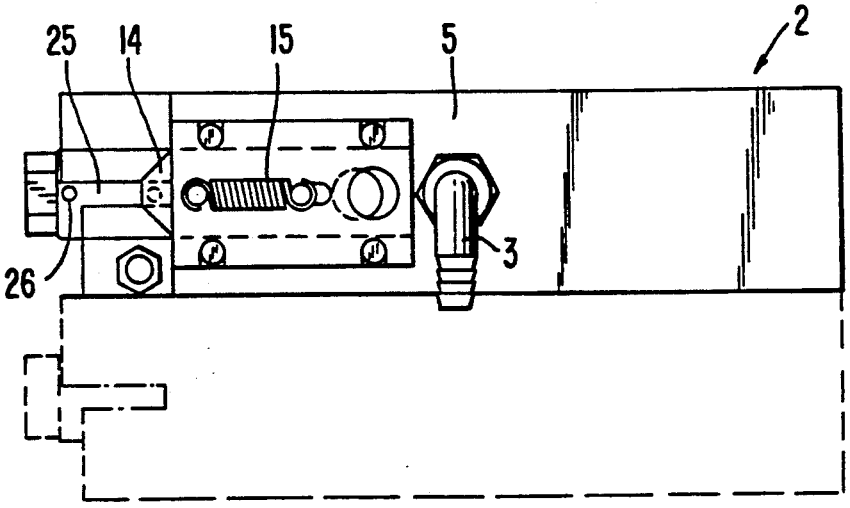

IX

AUTOMATED CLEANING DEVICE FOR BEVERAGE DRAFTING AND DISPENSING SYSTEMS

BACKGROUND AND SUMMARY OF THE INVENTION

The present invention relates to an automated cleaning device for beverage drafting and dispensing systems, particularly for beer tapping systems in bars and restaurants. More specifically, the present invention provides a sliding valve with cuboid housing equipped with connecting sleeves to a tap line leading to a tapping cock, to a tap line leading to a keg or barrel and to a pressurized water line.

An automated cleaning device is shown in DE-PS 35 04 636. That device was the first to provide either the cleaning of the tap line to the tapping cock or, alternatively, the tap line to the keg. That device is also distinctly smaller, simpler and especially more beverage conforming than an earlier version shown in DE-OS 33 02 908, because it avoids bulky valve and check-valve configurations as well as horizontal, sharply angled beverage lines.

Although the device shown in DE-OS 33 02 908 is remotely operated via an electric motor, it requires too much room to be feasibly installed in common drafting or dispensing systems. This results in the remote operation feature generally not being used. Another key practical disadvantage of that device is the fact that the line leading to the keg has to be manually disassembled in usually a tight space, manually cleaned and manually reassembled whenever cleaning of that line is required, or whenever a new keg is connected.

Compared to that device, the unit shown in DE-PS 35 04 636 has the advantage of being of compact, space saving construction. Beverage carrying lines are exclusively ascending, straight and angle-free. It is especially important that it also allows the cleaning of the line to the keg without requiring it to be disassembled. That unit has, however, the disadvantage of having to move the sliding valve manually, i.e., not being remotely operable. In addition, the construction of the sliding valve is not optimized due to its square design and due to the switching device being located inside the sliding valve. The manufacturing of square fittings is also complex. Such square designs are also difficult to seal. Consequently, the sliding valve in the prior art is comparatively expensive.

An object of the present invention, therefor, is to design those cleaning devices more simply and more competitively, to make them universally applicable and to allow remote operation.

The foregoing objectives have been achieved by providing an automatic cleaning device in which the sliding valve is designed as a cylinder which can be turned around its longitudinal axis. A housing provides a single-ended sleeve bore for the sliding valve, which has a larger diameter than the sliding valve itself to function as a cylinder cavity. At the same end, the sliding valve is enlarged to function as a piston sliding in the cylinder cavity and to form a dual-acting hydraulic cylinder.

In addition, a retention hopper is connected to the housing containing elastic, porous cleaning balls to be inserted in the tap lines. The outside (OD) diameter of the balls is slightly larger than the inside (ID) diameter of the beverage carrying lines. At the connection point between the hopper and the housing, a spring loaded, annular sliding valve is designed as an outlet barrier for the cleaning balls. The housing itself contains a movable, sealed sliding valve equipped with a horizontal cross bore at one end and a specially formed cavity to accept the cleaning balls at the other end. In the tapping or dispensing position, the cross hole is in line with the sleeves of the two beverage carrying lines, while, at the same time, the cavity is in line with the outlet/annular sliding valve of the cleaning ball hopper. When moved into the cleaning position, the cavity is in line either with the sleeve of the tap line leading to the tapping cock or with the sleeve of the tap line leading to the keg, while, at the same time, a flow path through the housing and the sliding valve is opened from the sleeve of the pressurized water line to the cavity containing the cleaning ball.

Each cylinder can be filled with pressurized water controlled by a respective solenoid valve attached to the housing. A first solenoid valve is attached to a cover plate at the end of the housing. A second solenoid valve opens to a circular recess which is positioned at the end of the sleeve bore for the sliding valve. By opening the water-pressured, second solenoid valve, the piston and with it, the sliding valve, move into the cleaning position. The flow of the clean, pressurized water leads from the circular recess via the housing channels through the cross hole of the sliding valve, from here through another housing channel to a circular recess of the sliding valve, which is open to an endwardly enclosed, central pocket drilling of the sliding valve, which in turn is open to the cleaning ball cavity.

An enclosed end of the sliding valve incorporates a pilot pin which moves in a longitudinal groove of the housing. One half of the face of the housing is shortened, allowing the sliding valve and pilot pin to be turned by 180° around their longitudinal axis using a tool, thus enabling the cleaning of the tap line to the keg, respectively, whenever the pilot pin is removed from the longitudinal groove, or the sliding valve is positioned in the drafting/dispensing position. The solenoid valves are electrically controlled from a switch located close to the tapping cock or, alternately, from a second switch attached to the housing.

In the presently preferred embodiment of the present invention, the cleaning device is equipped with a cylindrical sliding valve moving in a cylindrical bore of the housing. A square design of the movable and sealed components is thus avoided, ensuring reliable sealing as well as simple and cost efficient manufacturing.

A further simplification and thus an advantage of the present invention resides in the elimination of the switching device inside the sliding valve. Furthermore, the cleaning ball cavity is formed as a simple cross-pocket drilling of the longitudinally turnable valve. In this manner, the cleaning balls can alternately be inserted into either the tap line leading to the tapping cock or into the line leading to the keg.

It is especially advantageous that the dual-acting hydraulic cylinder for the valve operation is an integrated component of the sliding valve itself, thus allowing a remote operation by means of the incorporated solenoid valves and the electric switch at the tapping cock without the previously bulky construction and without impairing the quality of the beverage. Remote cleaning operation of the line leading to the keg from the tapping cock location, however, is blocked for safety reasons to avoid accidental water ingress and the insertion of a cleaning ball into the keg.

Since the cleaning of the line leading to the keg is only performed when changing a keg which requires the presence of a person at the location of the cleaning device, it is an advantage to require that the sliding valve be turned manually with a tool because this requirement promotes safety and eliminates excessive technical solutions.

It must be added that a remote operation for turning of the sliding valve is not beyond the scope of the present invention. Such a potential remote operation, however, requires additional technical efforts not only regarding the actual turning method, but, especially, concerning the prevention of pressurized water entering the keg.

Another major advantage of the cleaning device of the present invention is the use of pressurized water to operate the dual-acting hydraulic cylinder and, at the same time, to drive the cleaning ball and subsequently cleaning the tap lines whenever the device is switched to the cleaning position. Thus, there is a constant exchange of the pressure medium in the hydraulic cylinder assuring reliably that in no event, even in the case of a hypothetical malfunction, any foreign substance (e.g. hydraulic oils, etc.) could be introduced to the line system, since no such foreign substance, liquid or other medium is being used.

The present invention furthermore assures that the potential of stagnant water is eliminated, especially when the sliding valve is in the tapping position. Stagnant water could, even with the utmost hygienic precautions, become contaminated and result in promoting bacteria formation.

The present invention provides for solenoid valves and fittings to be designed and located in easily accessible, spacesaving positions. The adjustable pressure reduction valve permits operation with controlled pressures. Thus the cleaning device becomes independent of varying and fluctuating water pressures of the public utility system.

The present invention permits special treatment of the entire tapping/dispensing system, including the sliding valve, from time to time, e.g. for purposes of a complete disinfection treatment, in which case an appropriate chemical substance is, by remote control, injected into the system via the second solenoid valve.

The present invention promotes the design and construction of space saving blocks of sliding valves and enhances the operational reliability of the system. The pilot pin at the end of the sliding valve is located outside the groove in the housing whenever the unit is in tapping position. The sliding valve could, therefore, be accidentally twisted or could not have been moved back in the correct position after cleaning the tap line leading to the keg. In such a case, switching to the cleaning position from the remote location at the tapping cock, could result in accidental dilution of the beverage in the keg if the keg was already connected. Since the switch at the tapping cock is blocked in the present invention, such a mistake can not occur.

The present invention expands the universal applicability of the cleaning device for the following reasons. Many drafting/dispensing systems are equipped with so-called compensation tapping cocks. Such compensation tapping cocks are equipped with a central sliding piston at the cock connecting sleeve, allowing only an annular gap for the passage of the beverage. This central sliding piston is cone-shaped on the flow side. Opening of the cock generally results in a pressure decrease of the beverage in the cock and in the tap line. If the carbon dioxide pressure in the beverage is high, this pressure may be explosively released more or less far back into the line, depending on the individual properties of the beverage. In this case, the beverage may splash inconsistently and jerkily in a foamy consistency from the tapping cock.

Compensation tapping cocks create a relatively high, controlled flow resistance immediately in front of the cock by means of the central sliding piston, thus preventing undesirable pressure loss in the line in front of the cock. Therefore, it allows drafting of even highly sensitive beverages with a high gas pressure in a reliable and undisturbed fashion. Since the sliding piston reduces the ID-diameter of the tapping cock to the above-mentioned annular gap, the traditional cleaning ball cannot pass through. The utilization of the cleaning device would, therefore, only be possible if the compensation tapping cock would be unscrewed prior to the cleaning process and replaced afterwards. This cumbersome procedure would seriously jeopardize any advantages gained from the remote operated cleaning process.

The outward-transfer unit of the present invention for the cleaning balls avoids the above-mentioned. The tapping cock does not have to be unscrewed since the cleaning ball is automatically extracted. This is accomplished by a springloaded annular sliding valve. When the cleaning ball reaches the entry hole of the valve, it is pushed in front of the diameter-reduced through hole and seals its entry. This results in a pressurizing of the sleeve valve against the spring pressure towards the tapping cock. Once the opening for the cleaning ball with the sleeve valve has been moved far enough, i.e. across the vertical end of the tubular pipe, the pressurized water finds an egress and the flow or the pressure extracts the cleaning ball out underneath, while the safety pin prevents the cleaning ball from being pushed too far towards the tapping cock.

BRIEF DESCRIPTION OF THE DRAWINGS

These and other objects, features and advantages of the present invention will become more apparent from the following detailed description of a preferred embodiment of the present invention when taken in conjunction with the accompanying drawings wherein:

FIG. 1 is a partial cross-sectional elevational view of the sliding valve system of the present invention, including two solenoid valves in a drafting/dispensing position;

FIG. 2 is a top view of the sliding valve system shown in FIG. 1;

DETAILED DESCRIPTION OF THE DRAWINGS

Figures 8, 9:
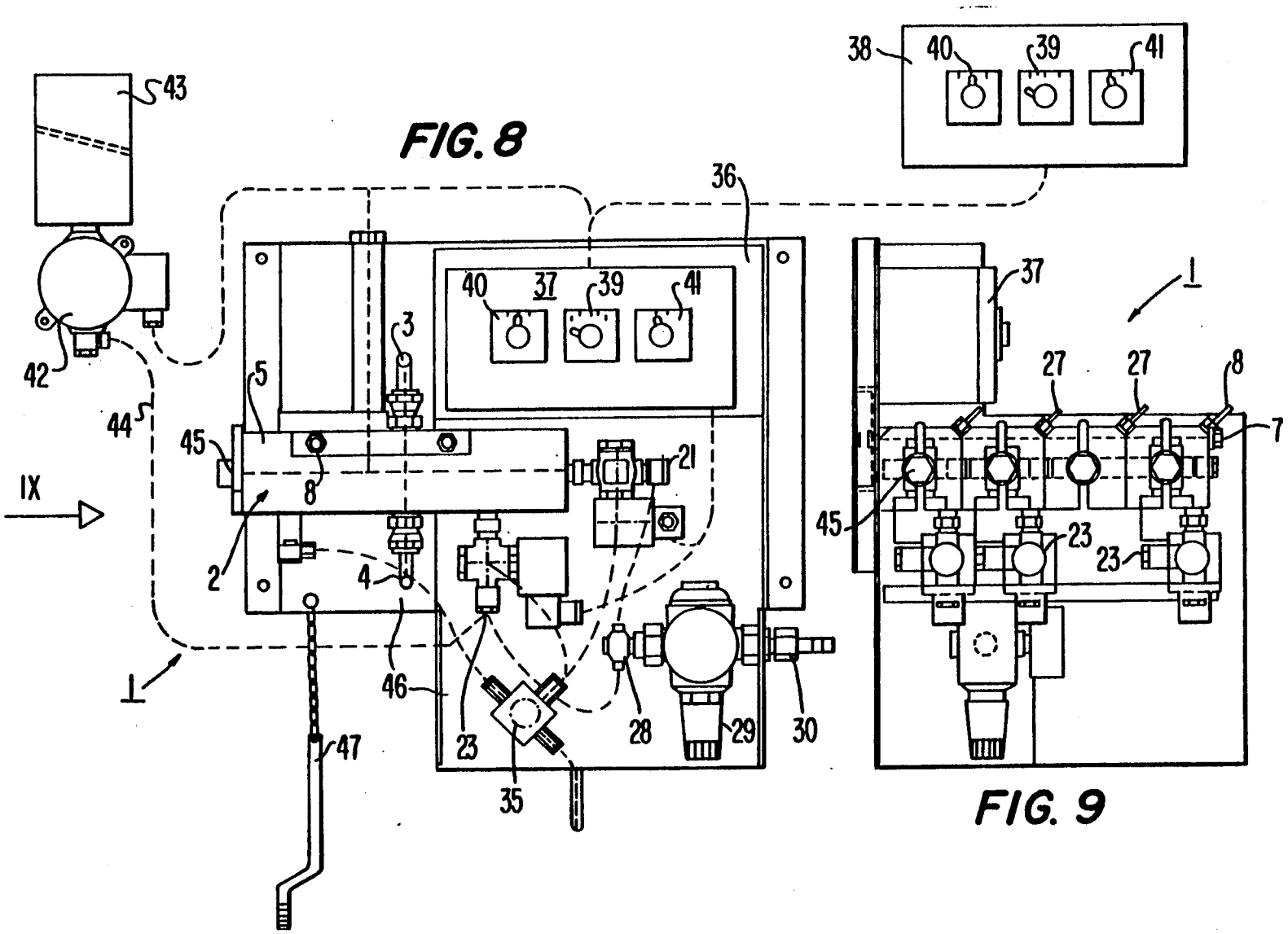
FIG. 8 is a side view of the complete cleaning device.
FIG. 9 is a front view of the complete cleaning device in the direction of arrow IX in FIG. 8.
Figure 10:
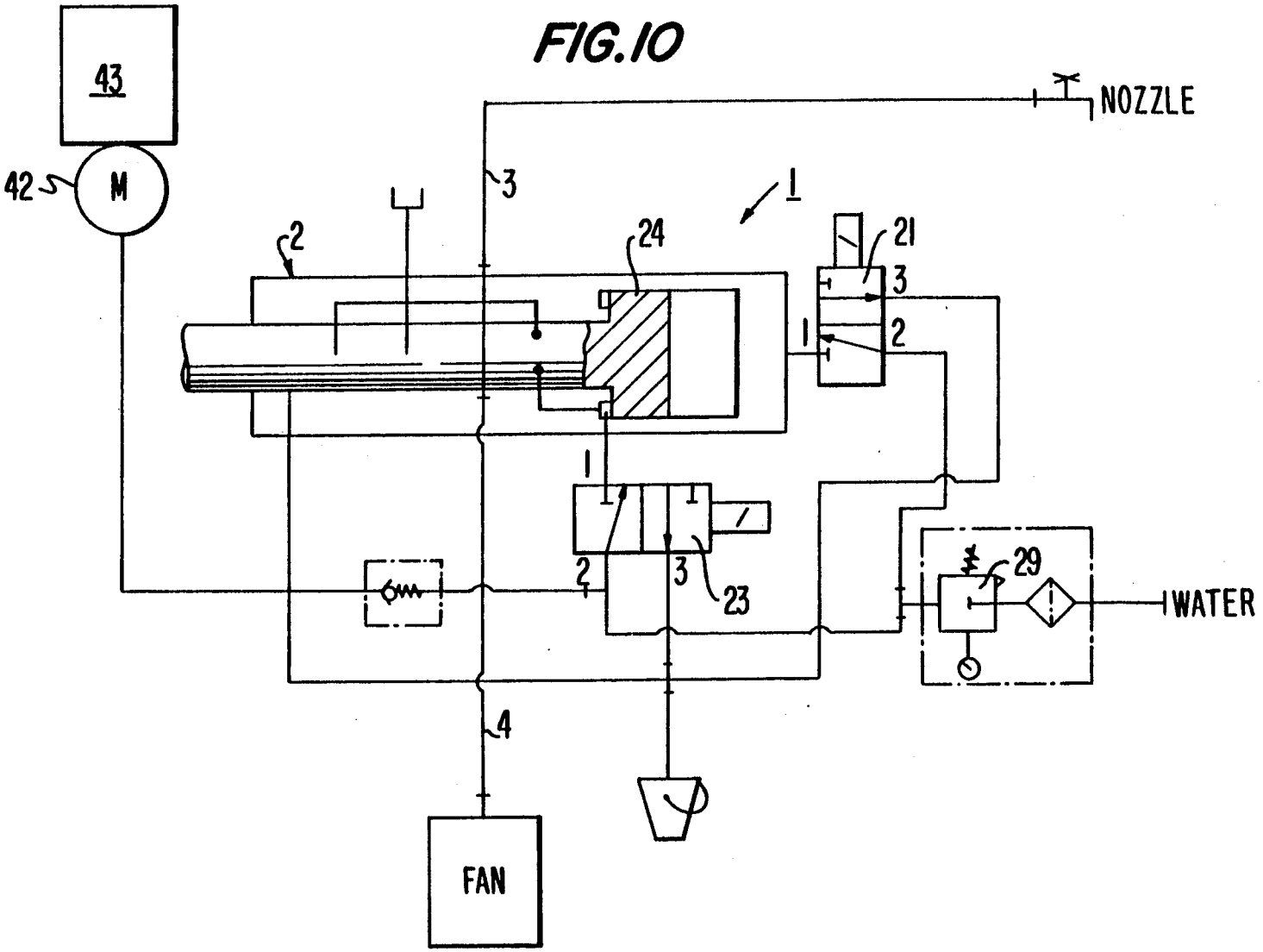
FIG. 10 is a water-flow-diagram of the cleaning device of the present invention including the tap line leading to the tapping cock and the tap line leading to the keg.

Referring first to FIG. 10, a cleaning device of such systems for beverage drafting/dispensing systems is designated generally by the numeral 1. The key component is at least one sliding valve system 2 shown in greater detail in FIG. 1. There is one sliding valve system 2 for each tap line leading to a tapping cock 3 and also for the corresponding tap line leading to a keg 4. As shown in FIGS. 8 and 9, two or more sliding valve systems 2 for two or more tap lines can form a block unit.

Each sliding valve system 2 has a cuboid-shaped housing 5 with two cross holes 6 in the top section. Tapped bolts 7 are inserted through the cross holes 6 and fitted with nuts 8 at their ends (FIGS. 8 and 9) so that two or more housings 5 can be interconnected to a block unit.

As shown in FIG. 1, the housing 5 has a central, cylindrical bore to accept a cylindrical sliding valve 9 equipped with a vertical crosshole 10 which is in line with tap lines 3 and 4 when in a drafting/dispensing position.

In addition, the sliding valve 9 is equipped with a cross pocket drilling or cavity 11 which is positioned underneath a cleaning ball hopper 12 and an appropriate opening 13 of the housing 5 when in the drafting/dispensing position shown in FIG. 1. The cleaning ball hopper 12 is attached to the top of the housing 5 and is equipped with an annular valve 14 located in front of the opening 13. The valve 14 acts as a cleaning ball barrier and is held in place via the bias of spring 15.

Inside the cleaning ball hopper 12, cleaning balls 17 are stacked on top of each other, where they can be retained via a weight 16 or be springloaded. These cleaning balls 17 are made of an elastic, porous material and have an OD-diameter which is slightly larger than the ID-diameter of the tap lines 3, 4. When these cleaning balls 17 are pushed through the tap lines 3, 4 by pressurized water, they are compressed and the resulting friction between the balls and the walls of the top lines cleans the interior walls of the tap lines 3, 4.

As shown in FIGS. 1, 2, 4, 5, and 6, the sliding valve 9 is enlarged at the right-hand side to form a piston 18. The housing 5 is bored accordingly and thus forms a cylinder cavity 19 enclosed with a cover plate 20 at the housing end. This cover plate 20 incorporates a first solenoid valve 21. At a face between the cylinder cavity 19 and the cylindrical bore for the sliding valve 9, the housings is equipped with a circular recess 22 which is open to the piston 18. Connected to this circular recess 22 is a second solenoid valve 23, fitted to the side of the housing 5. This arrangement forms a dual-acting hydraulic cylinder 24 shown schematically in FIG. 10.

Figure 3:
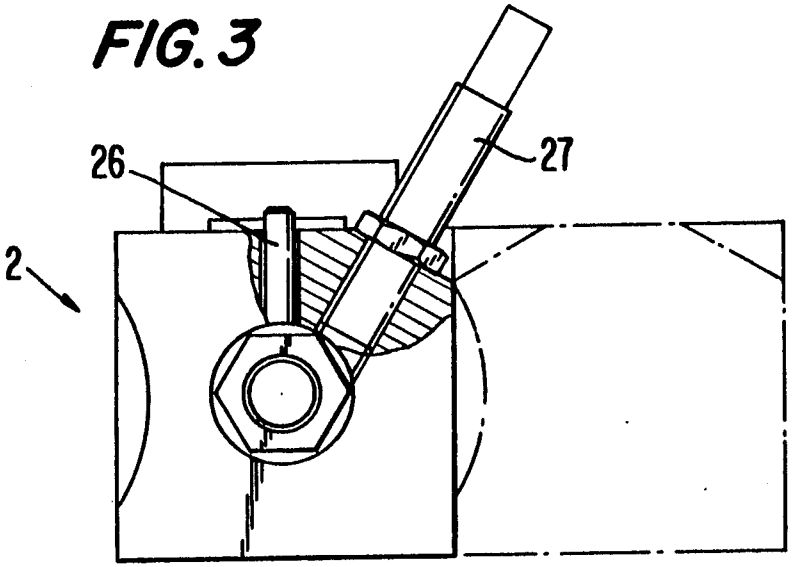
FIG. 3 is a front view of the sliding valve system in the direction of the arrow III in FIG. 1, partially cut away and slightly enlarged.
Figure 7:
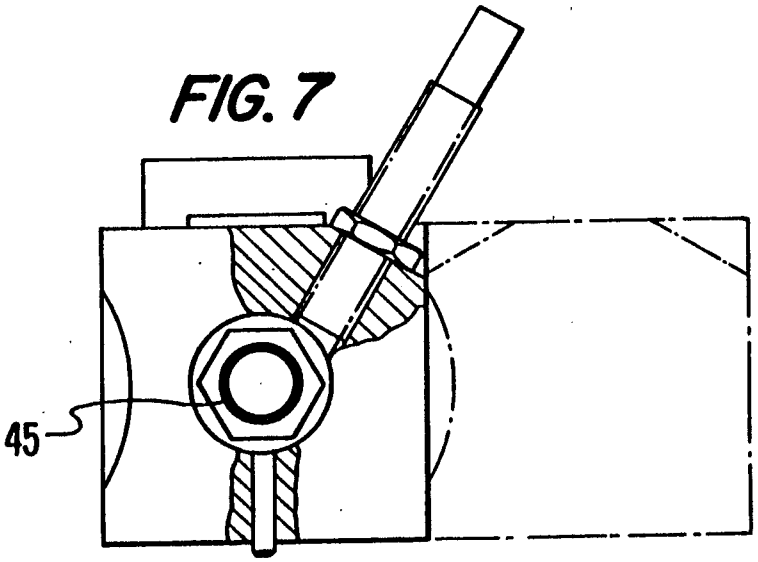
FIG. 7 is a front view of the sliding valve in the direction of arrow VII in FIG. 5, partially cut away and slightly enlarged.

A centered, longitudinal groove 25 is provided on the top and bottom of the left side of the housing 5. Pointing upward in FIG. 1, a pilot pin 26 is attached to the end of the sliding valve 9. Sliding in the longitudinal groove 25, the pilot pin 26 fixes the reversible position of the sliding valve 9 as it is moved by the dual-acting hydraulic cylinder 24. In the positions shown in FIGS. 1 and 2, the sliding valve 9 can be turned longitudinally by 180°, in which case the pilot pin 26 slides alongside the half sheared face of the housing 5. The turning position of the sliding valve 9 is registered by a proximity switch 27 shown in FIGS. 3 and 7.

Figure 4:
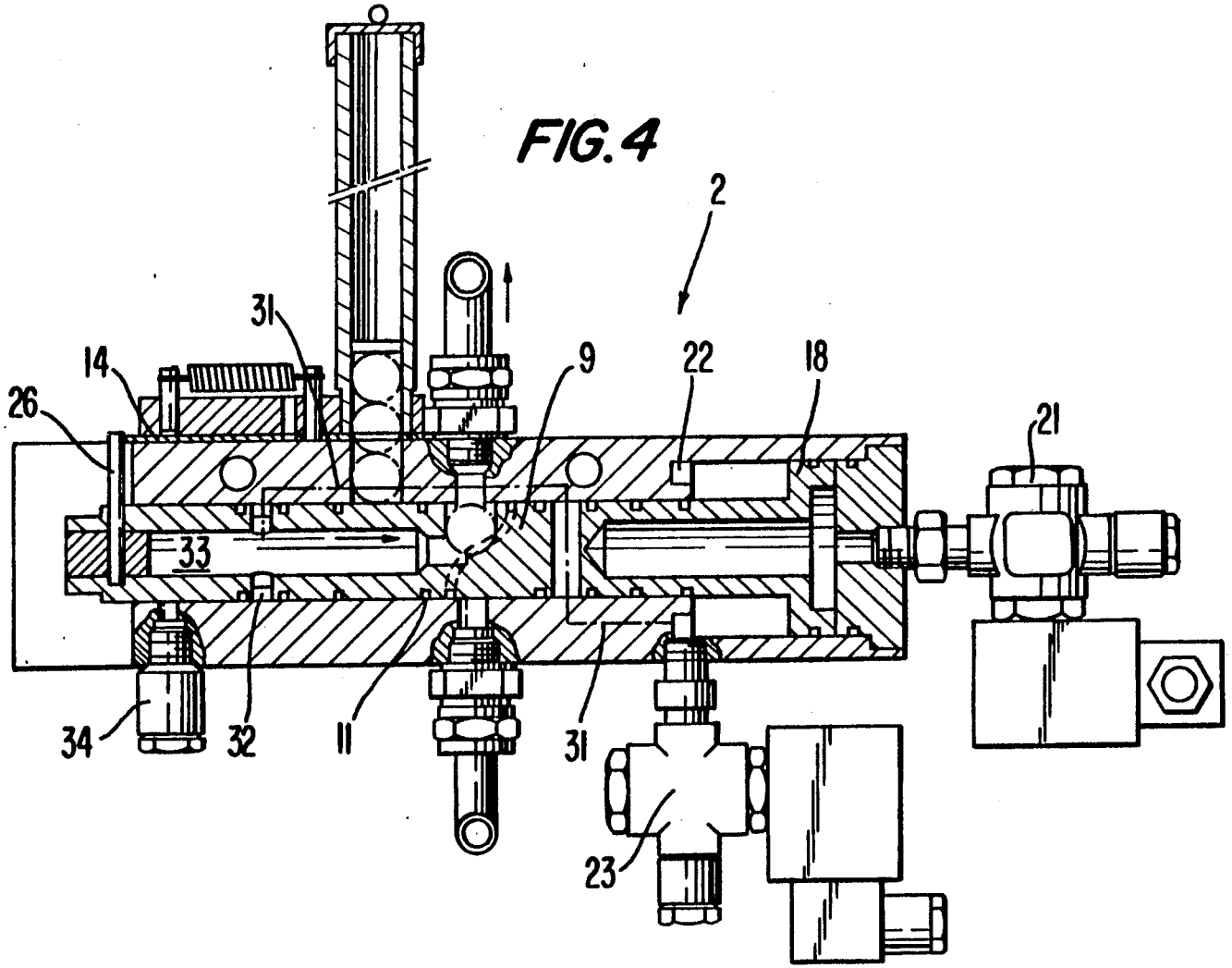
FIG. 4 is a view similar to FIG. 1, but showing the sliding valve in cleaning position for the tap line leading to the tapping cock.
Figure 5:
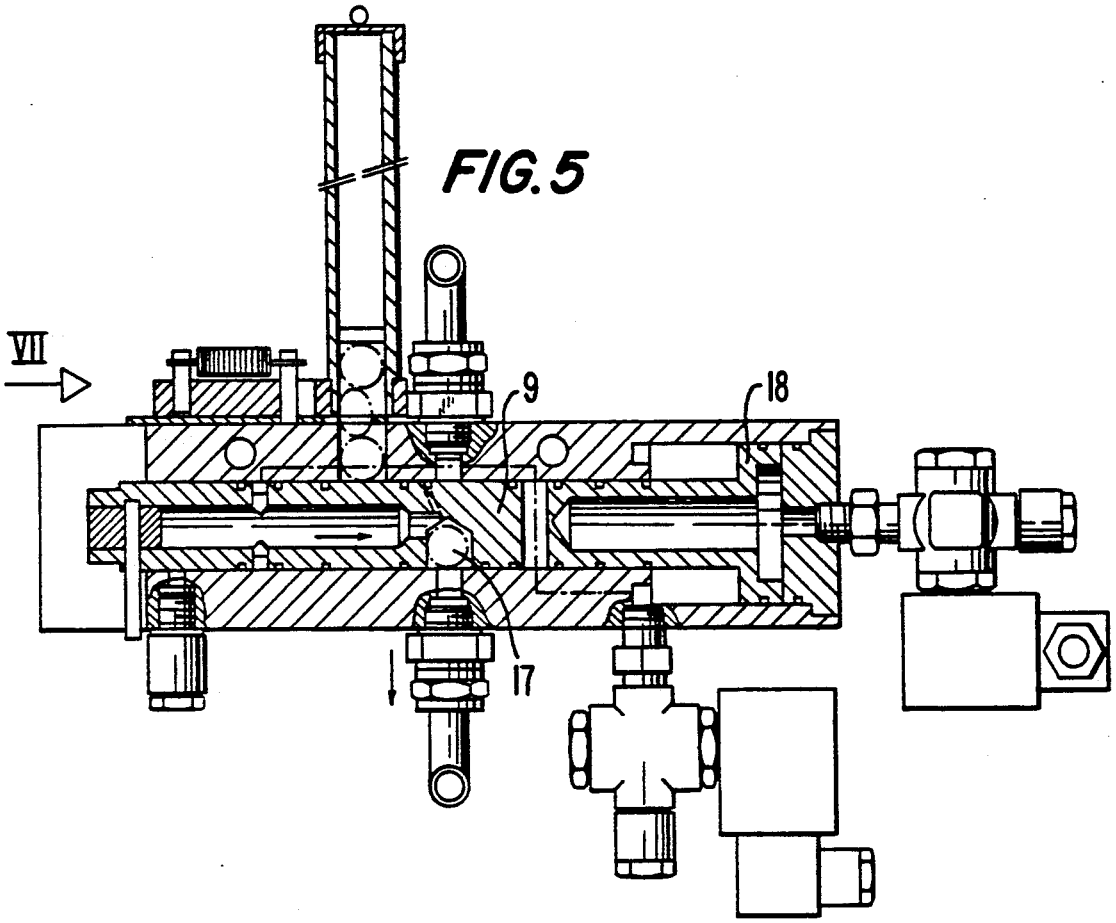
FIG. 5 is a view similar to FIG. 1, but showing the sliding valve in cleaning position for the tap line leading to the keg.
Figure 6:
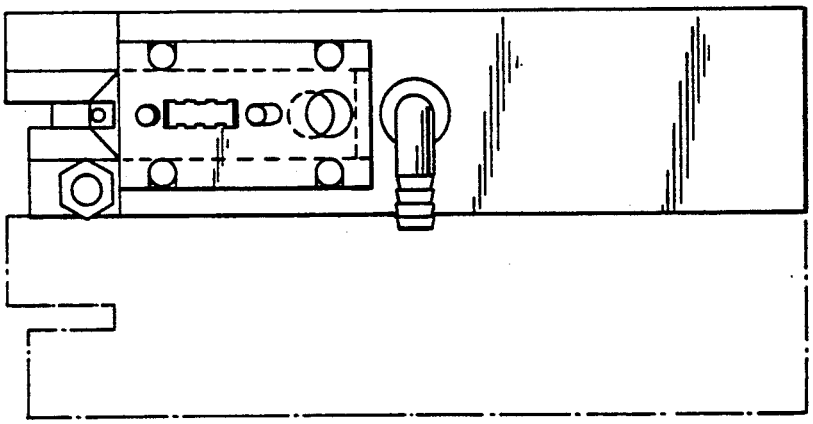
FIG. 6 is a top view of the sliding valve shown in the position in FIG. 5.

If, starting with the position shown in FIG. 1, the second solenoid valve 23 is activated, pressurized water from the low pressure side 28 (FIG. 8) flows through an adjustable pressure reduction valve 29, which is equipped with a water tap 30 constituting the high pressure side into the circular recess 22, pushing the piston 18 and the sliding valve 9 into the position shown in FIG. 4. At the same time, the pilot pin 26 moves the annular valve 14 in the same direction, allowing a cleaning ball 17 to drop down into the cavity 11. The cross pocket drilling or cavity 11 with the cleaning ball 17 therein is now under the tap line leading to the tapping cock 3 in the final position shown in FIG. 4.

At the same time, the cross hole 10 aligns with the housing channel 31 which has a single ended connection to the groove 22. Also, the other end of the housing channel .31 aligns with a circular recess 32 of the sliding valve 9 which is connected to an end-covered pocket bore 33. This pocket bore 33 extends all the way to the cross hole cavity 11 so that pressurized water flows from the circular recess 22 through the housing channel 31 through the cross hole 10 through the housing channel 31 into the circular recess 32 of the sliding valve 9 behind the cleaning ball 17 in the cavity 11. As described earlier, the cleaning ball 16 is now pushed through the tap line 3, while clean, pressurized water flows as long as the solenoid valve 23 is open.

After completion of the cleaning process, the second solenoid valve 23 is closed, and the first solenoid valve 21 is opened, initiating sliding valve 9 and piston 18 to return into the drafting/dispensing position shown in FIG. 1. At the same time, a new cleaning ball 17 drops into the cross hole cavity 11. The recess 32 of the sliding valve 9 now aligns with an excess water drainage sleeve 34 which is connected to the central excess water drainage system 35 (FIG. 8), also serving the first solenoid valve 21 as well as other sliding valves in a block unit.

All interior cavities of the cleaning device 2 are thus drained. No stagnant water remains to perpetuate or propagate bacteria.

By turning the sliding valve 9 through 180° from the position shown in FIG. 1 and thus moving the pilot pin 26 downward, the cleaning process can be repeated for the tap line leading to the keg 4 after activating the solenoid valve a second time.

After the sliding valve 9 has been moved back and reversed again, the annular valve 14 has to be operated manually to release another cleaning ball 17, since it is not automatically released with the pilot pin 26 in the downward position.

The solenoid valves 21 and 23 are operated by an electrical control unit 36. This control unit 36 is attached to the cleaning device 2, or a block of sliding valve systems, and is equipped with an incorporated switch panel 37 and a second switch panel 38 close to the tapping cocks (not shown).

Each switch panel 37, 38 has one central selector switch 39 which has as many positions as there are sliding valve systems 2 or tap lines 3. The lines requiring cleaning are selected via this switch 39. A control switch 40 with three positions controls the operation of the selected sliding valve system 2. Moving the switch from a neutral position to a working position activates the corresponding second solenoid valve 23. As long as the switch remains in the working position, clean pressurized water flows through tap line 3 or 4, respectively, depending on the turning position of the sliding valve even after the cleaning process may be completed, which is indicated by the exit of the cleaning ball at the end of the line. Moving the switch from the neutral position into a second working position results in the return of the sliding valve to the drafting/dispensing position. Returning the switch to the neutral position results in the maintaining of the drafting/dispensing position shown in FIG. 1.

The proximity switch 27 is connected to the control unit 36 and blocked by an electric lock which prevents the initiation of a cleaning process from the switch panel 38 at the tapping cock, if the pilot pin 26 of the sliding valve system 2 selected is in the downward position. The operation from the control unit 36 is, however, permitted.

Both switch panels 37, 38 are equipped with an additional switch 41. The initiation of this switch 41 activates a separate pump 42 which removes a liquid, chemical or other cleaning/disinfection solution from a reservoir 43 and injects it, via a separate line 44 and the selected sliding valve system 2, into the tap lines 3 or 4 which require cleaning.

A hex-head 45 is provided at the left end of the valve to turn the sliding valve 9 through 180°. An appropriate wrench 47 for the turning operation is attached via a chain or cord to a mounting panel 46 which carries the entire device.

Figure 11:
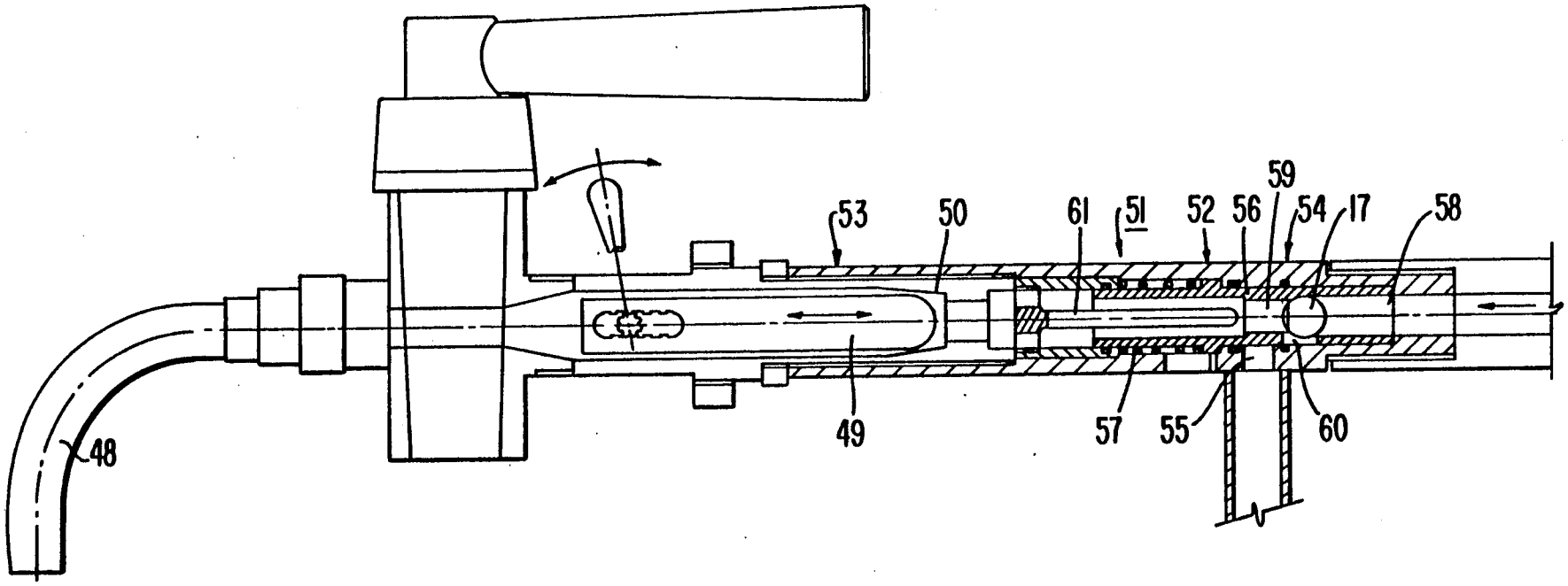
FIG. 11 is a partial cross-section longitudinal view of the compensation tapping cock with cleaning ball extraction device.

FIG. 11 illustrates a compensation tapping cock which includes a central sliding piston 49 to reduce the flow diameter to an annular gap 50 and prevent the passage of the cleaning balls 17. An automatic cleaning ball extraction device 51 is plugged into the cock and includes a T-shaped, tubular construction 52 with two horizontally aligned openings 53, 54 which are also aligned with the tap line 3 and the tapping cock respectively, and a perpendicular opening 55.

The tubular construction 52 has a sealed annular sliding valve 56 fitted thereto. The annular sliding valve 56 is biased by a spring 57 in the direction of the tap line 3. On the connecting side to the tap line, the ID-diameter of the annular sliding valve is equal to the ID-diameter of the tap line 58. On the connecting side to the tapping cock, the sliding valve 56 is equipped with a diameter-reduction fitting 59 in front of which is a cleaning ball extraction opening 60.

A set pin 61 is centrally fitted into the tubular construction 52 in the direction of the tap line 3 and adjacent the perpendicular open end 55.

The cleaning ball 17 fits valve-like onto the front of the diameter reduction fitting 59. When pressure builds, the annual sliding valve 56 retrieves against the bias of the spring 57. When the cleaning ball extraction opening 60 is aligned with the open end 55, the cleaning ball 17 drops out, assisted by the set pin 61. Consequently, pressure releases and the annular sliding valve 56 moves back into its starting position under spring bias and allows clean, pressurized water to flow through the compensation tapping cock.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. An automated cleaning device for beverage drafting/dispensing systems, comprising a housing operatively connected with a tap line leading to a tapping cock, a second tap line leading to a keg, and a third tap line connecting with a pressurized fluid cleaning line; a retention hopper for cleaning balls having slightly larger outside diameter than an inside diameter of the tap lines into which they are adapted to be inserted; a first sliding valve to control release of the cleaning balls; a second sliding valve inside the housing providing a drafting/dispensing position in which a cross hole in the second sliding valve is in line with the two beverage carrying tap lines and a cleaning ball cavity is aligned with the retention hopper and a second, cleaning position which provides alignment of the cleaning ball cavity selectively with one of the tap lines leading to the tapping cock and to the keg and, at the same time, opening a flow from the pressurized fluid cleaning line to the cleaning ball cavity; and two solenoid valves operatively associated with the housing for selectively supplying pressurized fluid to cylindrical cavities in the housing to actuate said second sliding valve between the drafting/dispensing position and the second, cleaning position.

2. The automated cleaning device according to claim 1, wherein the second sliding valve is a cylinder arranged to be longitudinally turnable inside the housing which is provided with a single ended bore forming a cylindrical cavity, and the second sliding valve being provided with an enlarged portion forming a dual-acting hydraulic piston operatively arranged to slide in the cylindrical cavity to define two working cavities.

3. The automated cleaning device according to claim 2, wherein a first of the two solenoid valves is attached to a cover plate at an end of the housing in communication with one of the working cavities, and a second of the two solenoid valves is operatively connected with an annular groove in the housing in communication with the second of the working cavities.

4. The automated cleaning device according to claim 3, wherein the piston and the sliding valve are operatively arranged to be moved into the cleaning position by actuating the second solenoid valve, whereby the pressurized fluid flows from the annular groove to the cross hole in the second sliding valve and then to a second annular groove in the second sliding valve which operatively communicates with the cleaning ball activity.

5. The automated cleaning device according to claim 4, wherein the solenoid valves, in their respective unactuated positions, provide a flow separate from the pressurized fluid cleaning line, and the working cavities are operatively connected to a central drain fluid system.

6. The automated cleaning device according to claim 5, wherein the housing is provided with a drain fluid sleeve which is connected to the central drain fluid system and with the second annular groove when the second sliding valve is in the drafting/dispensing position.

7. The automated cleaning device according to claim 2, wherein an end of the second sliding valve remote from the piston is provided with a pilot pin operatively arranged to slide in a longitudinal groove provided on the housing.

8. The automated cleaning device according to claim 7, wherein the face of the housing is shortened to permit the second sliding valve and the pilot pin to be turned 180° to and from a position to clean the line leading to the tapping cock from and to a position to clean the line leading the keg when the pilot pin is removed from the longitudinal groove.

9. The automated cleaning device according to claim 7, wherein the first sliding valve is a spring loaded annular sliding valve arranged on the housing to travel in the longitudinal groove and operatively associated with the pilot pin so as to be selectively movable by the pilot pin.

10. The automated cleaning device according to claim 1, wherein the solenoid valves are operable by an electrical control system with a first switch panel proximate the tapping cock and a second switch panel associated with the housing.

11. The automated cleaning device according to claim 10, wherein a cleaning agent container is associated with respect to the housing, and a pump having flow lines operatively connected with the second solenoid valve and the cleaning agent container is remotely controlled by the control system for moving cleaning agent from the container to the one tap line associated with the second solenoid valve in the second cleaning position.

12. The automated cleaning device according to claim 1, wherein an adjustable pressure reduction valve is operatively connected to the housing such that a high pressure side thereof is connected to a public water supply system or water line and the low pressure side is connected with the two solenoid valves.

13. The automated cleaning device according to claim 1, wherein is the housing is provided with at least two cross drillings for combining two or more sliding valve systems to a cleaning device block, and threaded bolts are provided for insertion in the at least two cross drillings, whereby a cleaning process is allowed for two or more parallel tap lines.

14. The automated cleaning device according to claim 1, wherein a proximity sensor is operatively arranged at a half sheared face of the housing provided with longitudinal grooves and being actuable to detect a turning position of the second sliding valve and thereby, via a disconnect switch at the control system, to interrupt a connection to a switch at the tapping cock when the turning position is in one of an upward and downward position.

15. The automated cleaning device according to claim 1, wherein a compensation tapping cock provided with a cleaning ball extraction device is arranged in the tap line upstream of the tapping cock.

16. The automated cleaning device according to claim 15, wherein the cleaning ball extraction device includes a T-shaped tube horizontally connected to the tapping cock on one end and to the tap line on the other end while a vertical end is pointed downward and open; a sealed, springloaded annular sliding valve in the direction of the tap line having a bore of identical inside-diameter towards the tap line and with a diameter reduction bore towards the tapping cock; a clean ball extraction opening on the tapping cock side; and a set pin attached in front of the sliding piston of the compensation tapping cock, extending through the bore of the annular sliding valve in the direction of the tap line with the free end valve in the direction of the tap line and with the free end of said set pin extending to the opening of the vertical end of the T-shaped tube.

* * * * *